US005400960A

United States Patent [19]

Jeffs

[11] Patent Number: 5,400,960

[45] Date of Patent: Mar. 28, 1995

[54] LETTER LOCKER MAILBOX ASSEMBLY

[76] Inventor: John T. Jeffs, 20594 Ottawa Rd., Apple Valley, Calif. 92308

[21] Appl. No.: 93,593

[22] Filed: Jul. 19, 1993

[51] Int. Cl.[6] ..... B65D 91/00

[52] U.S. Cl. ..... 232/43.1; 232/43.3; 232/45; 232/39

[58] Field of Search ..... 232/17, 27, 33, 39, 232/43.1, 43.3, 45; 248/146

[56] References Cited

U.S. PATENT DOCUMENTS

| | | | |
|---|---|---|---|
| 4,413,770 | 11/1983 | Nye | 232/17 |
| 4,901,913 | 2/1990 | Fischer | 232/17 |
| 5,096,115 | 3/1992 | Hassan | 232/17 |
| 5,207,377 | 5/1993 | Brecht | 232/17 |

*Primary Examiner*—Michael J. Milano

[57] ABSTRACT

The top door of the letter locker mailbox covers both the incoming mail chute, and the outgoing mail tray. This configuration provides the mail carrier with one or two less significant arm movements in servicing the mailbox. The door, chute and tray are weather protected by a solid, two inch weather shield. The top door is secured by a full length one inch magnetic strip. The bottom mail receiving and storage compartment is secured by a locking door, secured at the top center by a mail handling utility lock. The door is protected from theft by prying, by the weather security shield above, and weather security shields on both sides. The bottom door stainless steel rod hinge is permanent, secured in the assembly at the time of manufacturing, and cannot be pried. The construction and design of the entire mailbox is a unique, superior improvement. The entire compartment of the mailbox is constructed of Electro-galvanzied steel, 4 to 6 gauges heavier than comparable mailboxes. The doors of the mailbox are constructed of Electro-galvanzied steel, 6 gauges heavier than comparable mailboxes. The top and sides shell of the mailbox is one piece, 16 gauge steel, and solid protection against theft, vandalism and weather. The top door handle and hinge are stainless steel, heavier and superior to comparable mailboxes. The entire finish is powder coated, which is far superior to comparable mailboxes. Each major part is powder coated separately for maximum protection and durability. The pedestal post is constructed and powder coated for superior strength and protection. The prefabricated anchor is included, and unique to the letter locker mailbox assembly. The overall design and appearance is unique and superior to all other comparable mailboxes. Convenience for the mail carrier and owner, security for the mail, protection against vandalism, and a durable lifetime mailbox is the ideal we all hope for. Our mail is one of the most important things in our lives. The letter locker mailbox invention is the answer to that hope.

9 Claims, 12 Drawing Sheets

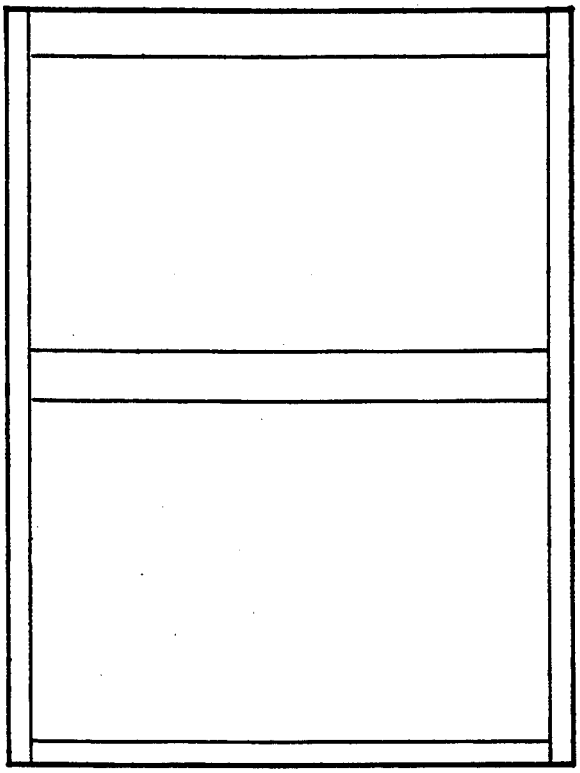
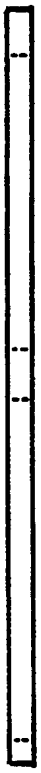
FIG. 6a
FIG. 6

LETTER LOCKER MAILBOX ASSEMBLY

SUMMARY

The letter locker mailbox assembly is designed, engineered and manufactured for either residential or commercial curbside mail delivery. It has been invented to provide the best overall mailbox for ease of operation for the mail carrier and the owner, and the best overall mailbox for resistance against weather, theft and vandalism. The only mailbox assembly of it's kind, complete with a prefabricated concrete anchor.

1. Constructed of 14 and 16 guage rust-free steel. All exterior and interior surfaces are powder coated for a durable finish against all weather conditions. Construction secured primarily by stitch and solid welds.
2. Constructed with a minimum of parts and hardware. The top door covers the incoming mail chute and the outgoing mail tray. It is designed for the ease of the carrier, and the purchaser, in such case the purchaser forgets to put the outgoing flag in the up position. The top door is secured by a full length magnetic strip latch for ease of operation and durability.
3. The incoming mail slot and chute drops into a large mail receiving compartment below. The opening of the mail slot, and the length of the mail chute will not allow anyone to reach in and steal mail. The mail receiving compartment below is secured by a locked door which can only be opened by the owner. The receiving compartment is of sufficient size to receive large quantities of mail for business owners, or for residential owners who may be away on vacation.
4. Construction of the one piece top and sides of the letter locker mailbox provides a weather shield hood for the entire face of the mailbox.
5. The pedestal post for the letter locker mailbox is constructed of 1/16" wall 4" round steel tubing, welded to 10 gauge steel top and base brackets, bent along the long sides for additional strength. The top bracket is secured by heavy bolts to the base of the mailbox. The base bracket is secured by heavy concrete anchor bolts in the prefabricated concrete anchor, or drilled and wedge anchored in existing concrete.

The letter locker mailbox is "the better mouse trap" of mailboxes. The inventor has been the sole proprietor a business of sales, installations, custom construction, service and repair of nearly every kind of residential and commercial mail handling equipment on the market for 5 years. The letter locker mailbox is a unique and complete assembly of mailbox, pedestal post and concrete anchor. A lifetime and affordable mailbox assembly.

DESCRIPTION OF DRAWINGS

FIG. 6. Front frame of mailbox.

FIG. 12-A Overall side view of the complete box, post and anchor assembly.

DETAILED DESCRIPTION

Figure 1:
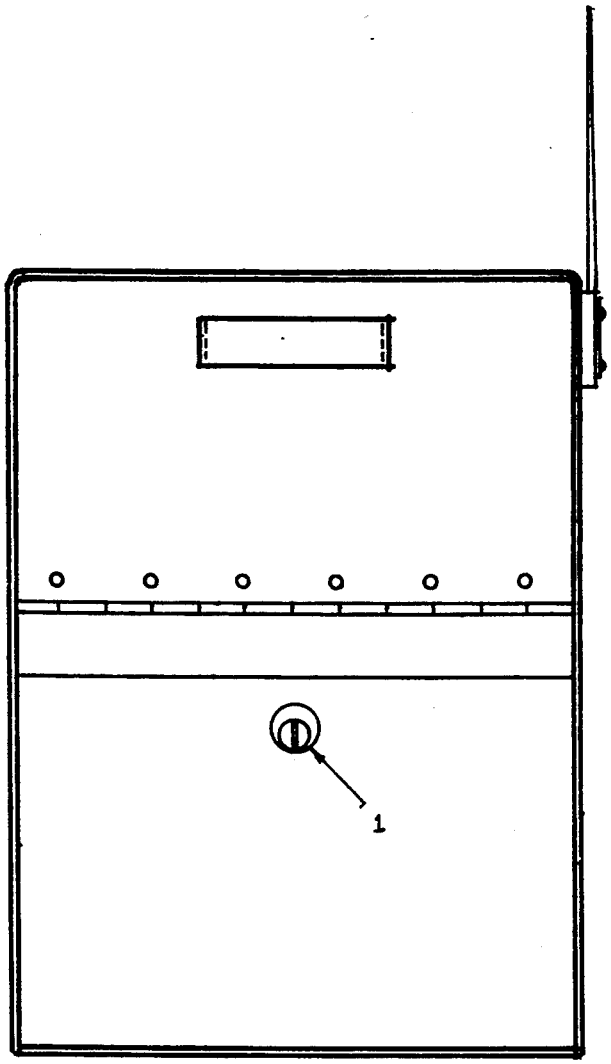
FIG. 1. Front view of mailbox—flag in up position.
Figure 2:
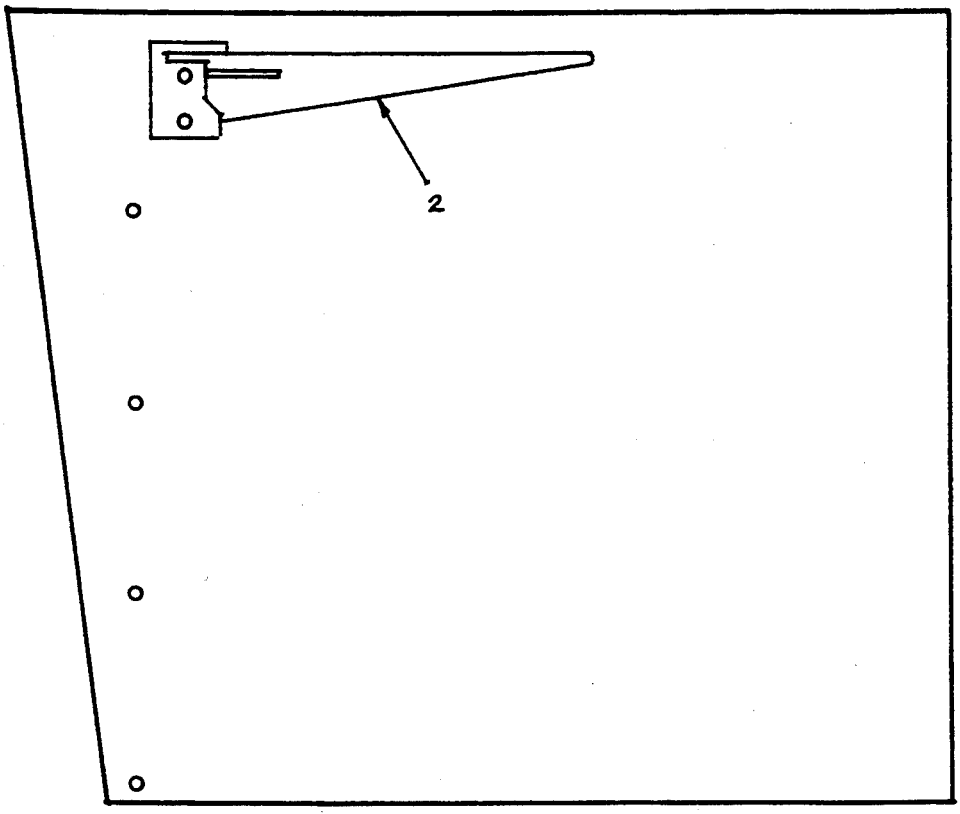
FIG. 2. Side view of mailbox—flag in down position.
Figure 3:
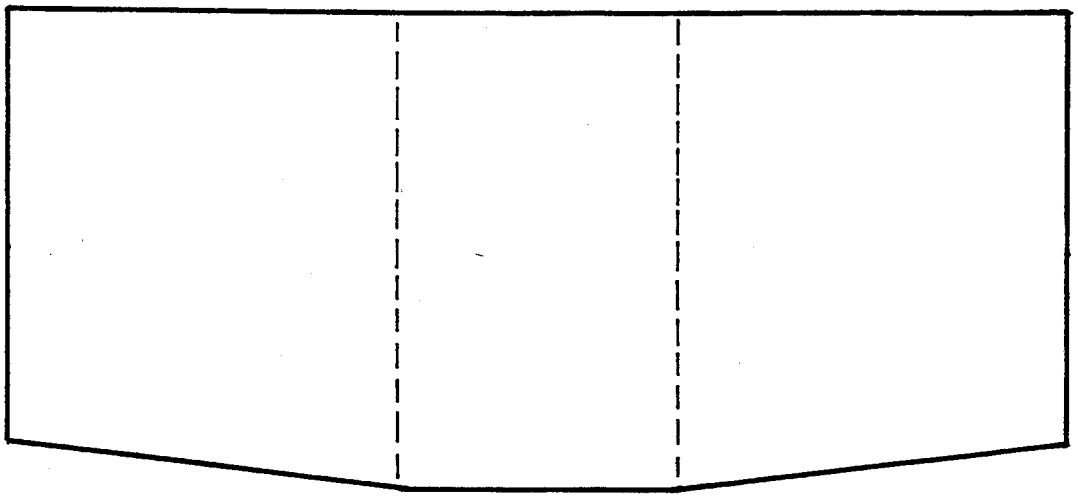
FIG. 3. Top and sides shell of the mailbox, before and after bending.
Figure 3A:
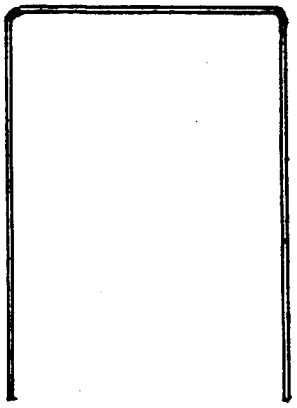
Figure 4:
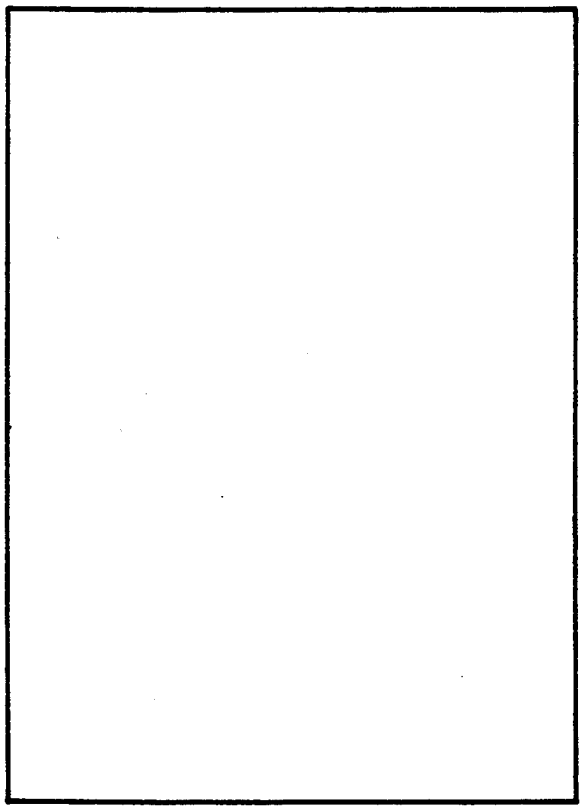
FIG. 4. Back piece of mailbox.
Figure 4A:
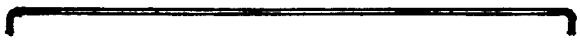
Figure 5:
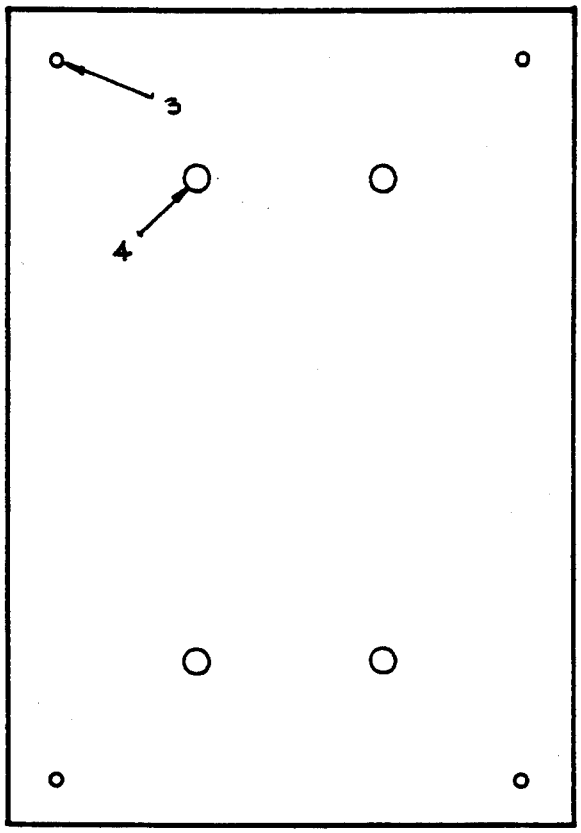
FIG. 5. Bottom/base piece of mailbox depicting drain and mounting holes.
Figure 5A:
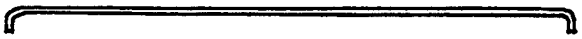
Figure 11:
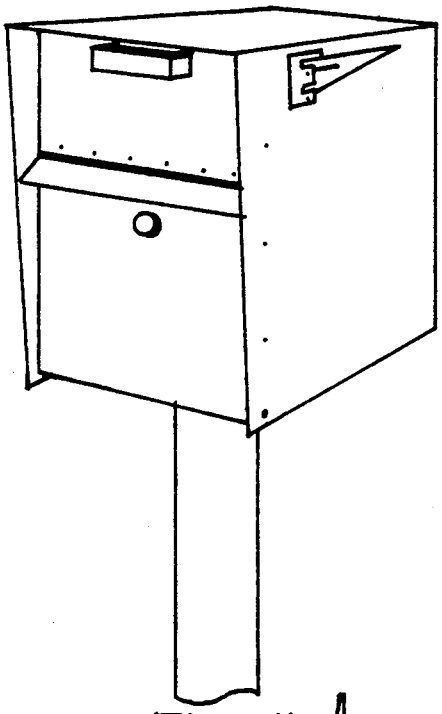
FIG. 11. Perspective view of mailbox with doors closed. Perspective view of mailbox with doors open.
Figure 11A:
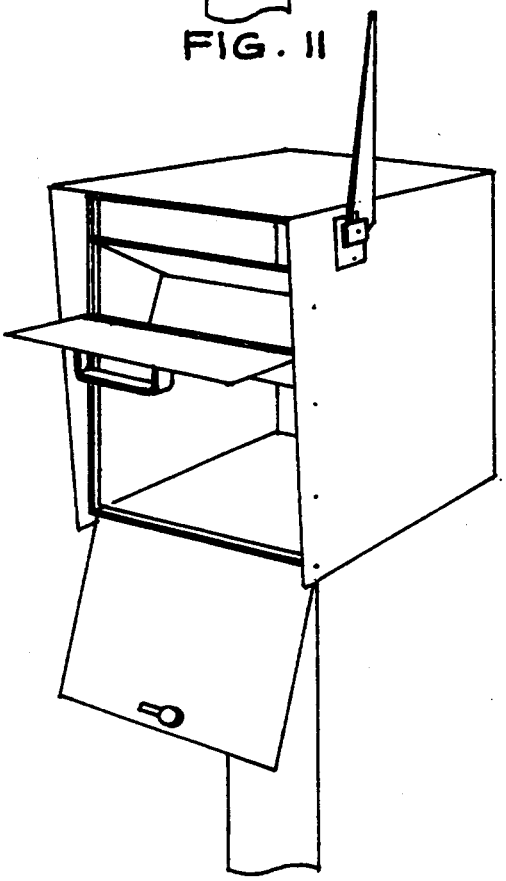

The general housing of the mailbox is constructed of three pieces. The top and sides shell, (FIG. 3.) is 16 gauge cold roll Electro-galvanized steel, bent at 90 degree angles, forming an absolute weather shield for the top. The front of the top and sides shell forms a tapered weather shield, from over 2 inches at the top, to ½ inch at the bottom, as depicted in FIG. 11. The back piece, (FIG. 4.) is 16 gauge cold roll Electro-galvanized steel, with ½ inch 90 degree bends, secured to the shell by stitch weld. The bottom piece, (FIG. 5.) is 14 gauge cold roll Electro-galvanized steel, with ½ inch 90 degree bends, secured to the shell by stitch weld. There are four ¼ inch drain holes, (Ref. No. 3) situated one inch from each of the comer sides. There are four 7/16 inch bracket mounting holes, (Ref. No. 4) centered 4"∴10" in the bottom piece. The general housing is assembled and powder coated separately, with the bottom door attached. This is the box shell assembly.

The from frame of the mailbox, (FIG. 6.) consists of five pieces of cold roll mild steel squared tubing welded together to form the frame. The sides and bottom of the frame are ½"×½" tubing. The top and middle of the frame are ½"×1" tubing. The two piece outgoing mail tray/slot, (FIG. 7.) is secured by welding to the middle and upper sides of the front frame. The entire assembly is powder coated separately prior to installation. The front frame assembly is installed in the front of the general housing by three ⅛ inch stainless steel rivets on each side, and the top of the shell.

Figure 7:
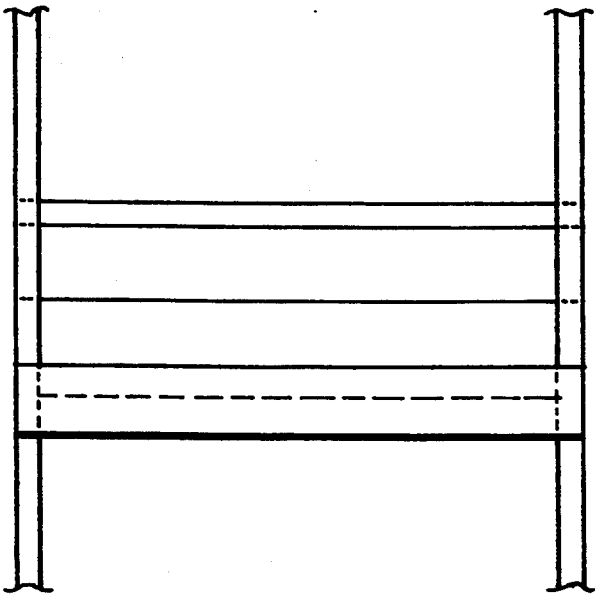
FIG. 7. Outgoing mail tray/slot. Front and side views.
Figure 7A:
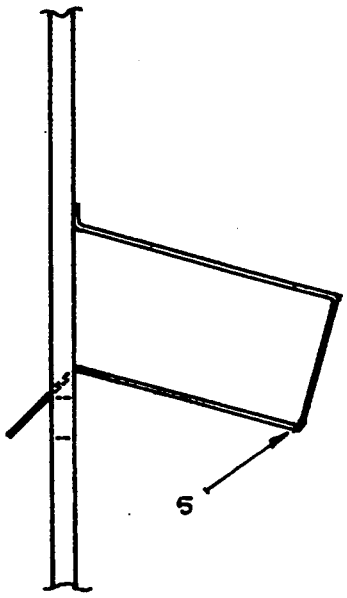

The two piece, 3"×11"×5" outgoing mail tray/slot, (FIG. 7—Ref. No. 5.) is constructed of two pieces of 14 gauge cold roll Electro-galvanized steel. The top piece is bent ½ inch at 110 degrees at the front edge, and 90 degrees at the back. The bottom of the back is stitch welded to the back edge of the bottom piece. There are two ¼ inch drain notches at the ends of the back edge of the bottom piece The front of the bottom piece is bent 2 inches at 120 degrees. This bend is secured to the top of the middle tubing of the front frame by stitch welding. The top piece bend is secured by welding to the backs of the upper middle of the two side tubing's of the front frame, thus forming a 2"×11" incoming mail slot opening at the top front of the mailbox. The outgoing mail tray/slot serves three general purposes.

1. The top piece completes the incoming mail slot, and chute to the lower mail receiving compartment. The mail drop is sufficient to prevent reaching in to take out mail.
2. The front of the bottom piece, (FIG. 11.) serves as a full width 2 inch weather shield over the top of the bottom door, and as a mounting surface for the hinge of the top door.

3. The two pieces together form the outgoing mail tray/slot.

Figure 8:
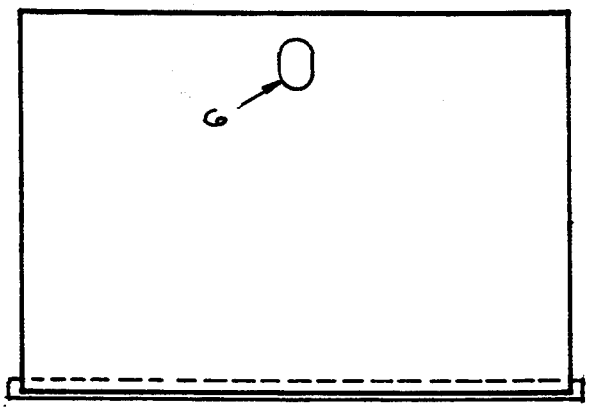
FIG. 8. Bottom door of mailbox depicting rod hinge, lock hole and lock.
Figure 8A:
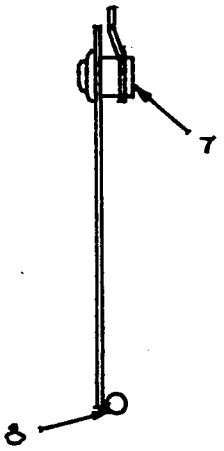

The bottom door, (FIG. 8.) is a 14 gauge cold roll Electro-galvanized steel 8"×11¾" locking door, covering the mail receiving and storage compartment capacity of 2 weeks or more of incoming mail. The bottom of the door has a ½ inch 90 degree bend that is welded to a ¼ inch stainless steel rod hinge, (Ref. No. 8,) The rod hinge is pre-installed through the front ½ inch bend in the bottom box piece and the lower from sides of the box shell, (FIG. 11.). The bottom door is secured by a Hudson utility lock, (Ref. No. 7.) commonly used in mail handling equipment. The lock is centered at the top of the door. The latch of the lock secures the door closed at the back of the lower side of the middle piece of the from frame, (FIG. 6.). The bottom door, (less lock) is attached by the rod hinge to, and powder coated separately, along with the box shell assembly.

Figure 9B:
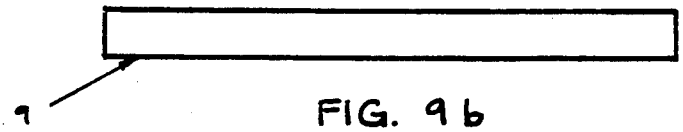
FIG. 9. Top door of mailbox depicting magnetic latch, handle and hinge.
Figure 9A:
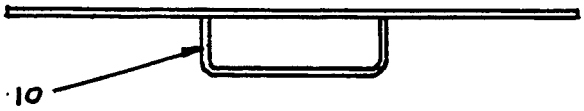
Figure 9:
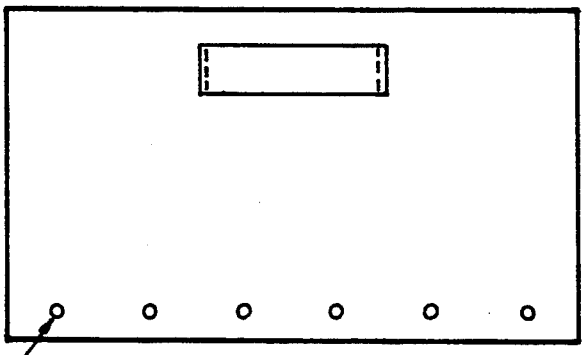
Figure 9C:
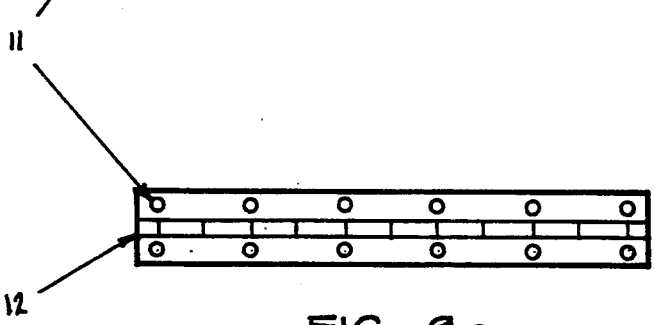

The top door, (FIG. 9.) is a 14 gauge cold roll Electro-galvanized steel 7"×11¾" door, covering the incoming mail slot and chute, and the outgoing mail tray/slot. The door is secured by a heavy duty 10¾ inch long, ¾ inch stainless steel piano hinge, (Ref. No. 12.). The piano hinge is secured to the weather shield piece, (FIG. 7.) of the lower outgoing mail tray by six ⅛ inch stainless steel rivets. It is secured to the lower inside of the door by six 8-32×5/16" stainless steel pan head phillips bolts, and six 8-32 stainless steel Nyloc nuts. The door handle, (Ref. No. 10.) is 1"×4" with 1¼ inch 90 degree bends, ⅛ inch stainless steel, welded to the upper middle portion of the door. The door latches at the top by means of a full length 1"×12" magnetic strip latch, (Ref. No. 9.) that is bonded to the face of the upper 1 inch tube of the front frame, (FIG. 6.). The top door is powder coated separately, prior to installation.

Figure 10A:
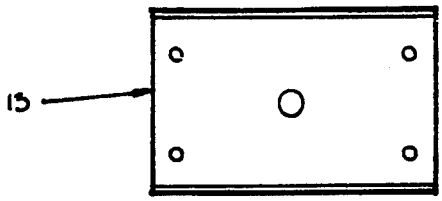
FIG. 10. Mailbox pedestal post depicting top and base mounting brackets, drain and mounting holes.
Figure 10:
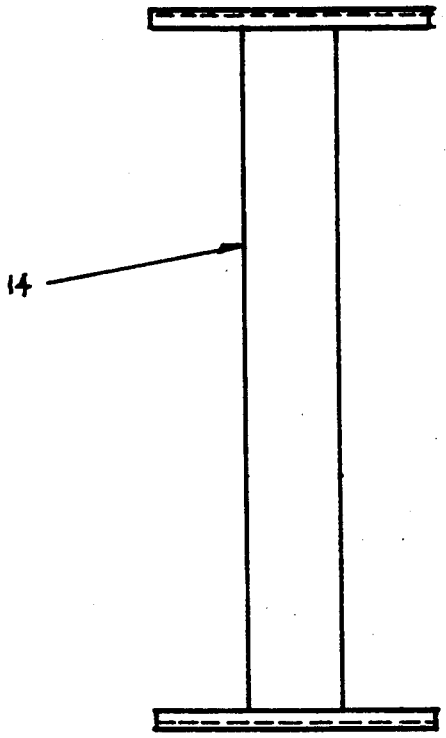
Figure 10B:
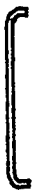
Figure 10C:
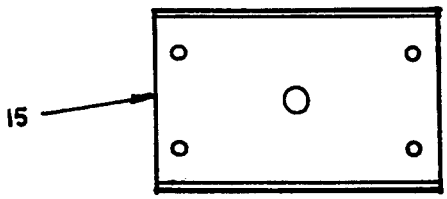
Figure 12B:
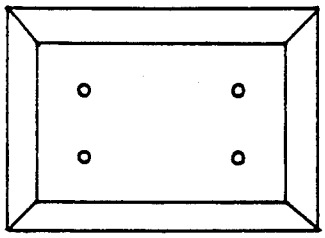
FIGS. 12 and **12*b*** Prefabricated concrete anchor with a section depicting "J" anchor bolts.
Figure 12:
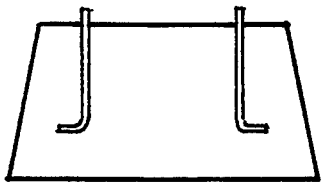
Figure 12A:
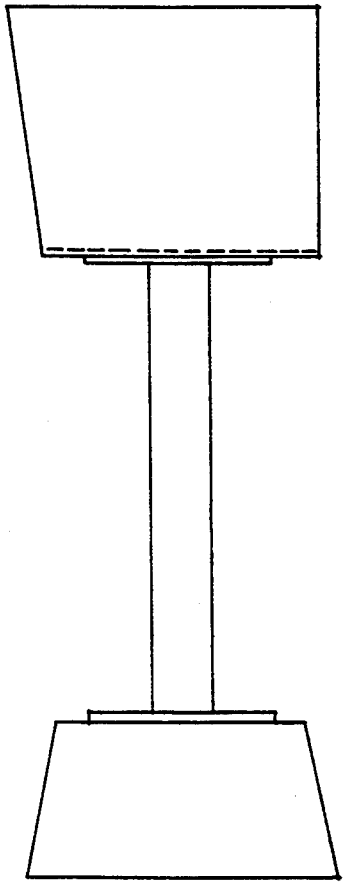

The pedestal post, (FIG. 10.) is 4 inch diameter round 1/16 inch wall mild steel tubing, 30 inches in length. The post is welded to top and base mounting brackets and powder coated. Each mounting bracket is 10 gauge cold roll Electro-galvanized steel, 7½"×12" with ¾ inch 90 degree bends on the long sides for channel strength. Each bracket has four 4"×10" centered holes for mounting bolts, and one ¾ inch heat drain hole for manufacturing purposes. The holes can also facilitate mailbox lighting, if desired. The top bracket mounting holes are 7/16 inch. The base bracket holes are ⅝ inch. The mailbox bottom is secured to the top pedestal bracket by four ⅜"×⅝" coarse-16 thread zinc plated bolts and ⅜ inch zinc plated Nyloc nuts with zinc plated SAE flat washers. The base bracket is mounted with either four ½"×4" galvanized wedge anchor bolts drilled and secured in existing concrete, ½ inch SAE zinc coated flat washers and ½ inch zinc plated Nyloc nuts, or by four ½×6" "J" galvanized anchor bolts cast in pre-fabricated concrete anchor, (FIG. 12.). The "J" bolts can also be cast in a formed concrete anchor slab on site.

The pre-fabricated concrete anchor with ½×6" "J" anchor bolts, (FIG. 12.) is wedged in shape so it cannot easily be uprooted from ground, and will not give way to wind, or by being pushed by a person or persons. The anchor will, however, give way to accidentally being struck by a vehicle, so as to prevent excessive damage to the mailbox and/or post, or anchor, thus preventing the need to purchase replacements. If uprooted by a vehicle, the anchor can simply be replaced in the ground. The anchor is 10 inches high, measures 10"×14" at the top, 14"×20" at the bottom, thus tapered on all four sides. Complete, it weighs approximately 150 pounds.

The mailbox flag, (Ref. No. 2.) is a standard common Steel City mailbox flag and bracket. It is secured on the side of the mailbox by a 10-24×⅝" pan head phillips stainless steel bolt and Nyloc nut at the flag, and a 10-24 C ½" pan head stainless steel bolt and Nyloc nut at the bottom of the bracket.

The above detailed description consitututes the letter locker mailbox assembly.

I claim:

1. A curbside theft, vandal and weather resistant mailbox, rectangular in shape having conveniently contiguous areas for incoming mail, outgoing mail, mail storage and retrieval access from substantially the same vertical level, and substantially constructed of generally flat, heavy duty rust-free metals and rust-free attendant hardware, said mailbox comprising:

an outer housing consisting of a single-piece top and sides, said sides equally bent down at right angles;

a vertical back attached to said outer housing at the rear top and rear sides of said outer housing;

a horizontal floor attached to said outer housing at the lower side of said vertical back and the lower sides of said outer housing, thus completing the basic structure of said outer housing;

said horizontal floor having a vertical mailbox post attachment region;

said outer housing extending and angled substantially forward from the bottom front of said sides, to the upper front of said sides and front of said top, to provide an overall weather shield for said areas of mail receiving, outgoing mail, mail storage and retrieval;

a substantially tubular steel, rectangular four-sided front frame, with a horizontal cross member, approximately centered vertically in said front frame, said front frame attached to the top,-floor and sides of the forward portion of said outer housing;

an inclined outgoing mail tray compartment formed substantially horizontal and sufficiently vertical by upper, rear and lower pieces contiguous to said outer housing sides and attached to said front frame, at the upper vertical sides of said front frame and below, to said horizontal cross member of said front frame;

said lower piece extending forward and angled down from said horizontal cross member, and inclined inward to said outer housing approximately half way from the front of said outer housing;

said rear piece bent at a right angle from the inward upper piece and attached to the inward lower piece, thus forming said compartment of sufficient size to handle quantities of outgoing mail;

a horizontal incoming mail slot and inclined chute formed within the uppermost and forward portion of said outer housing by the attachments of said front frame and said inclined outgoing mail tray compartment sufficiently below and in such a manner as to form said incoming mail slot opening of sufficient size to deposit quantities of incoming mail;

a mail storage and retrieval area inside the lower and remaining portion of said mailbox.

2. The mailbox, according to claim 1 and comprising:

a horizontal incoming mail slot and inclined chute, and inclined outgoing mail tray compartment, substantially dividing the upper half and face opening of said mailbox;

a vertical top door with a handle attached to the outer, upper center portion of said top door, enclosing said horizontal incoming mail slot and chute and said inclined outgoing mail tray compartment;

said top door attached and hinged at the bottom on the upper portion of a forward and downward angled portion of said lower and extended front portion of said inclined outgoing mail tray compartment, and secured at the top by a magnetic strip attached horizontally to the upper inside portion of said top door, thus latchable against the outer upper edge of said front frame;

a mail storage and retrieval area comprising substantially, the lower half area of said mailbox;

a vertical bottom door, contiguous to and directly below said top door, enclosing said mail storage and retrieval area of said mailbox;

said bottom door attached and hinged at the lower edge of said door with a horizontal hingeable rod secured at each end through holes in the lower front sides of said mailbox;

said bottom door is secured at the top with an outdoor mailbox utility lock at the center upper portion of said bottom door, underneath said downward angled lower extended front portion of said inclined outgoing mail tray compartment and secured behind said cross-member of said front frame.

3. The mailbox according to claim 1 wherein said inclined outgoing mail tray compartment is attached to said front frame whereby said front frame and said inclined outgoing mail tray compartment are attached to said forward portion of said outer housing, as a unit.

4. The mailbox according to claim 1 wherein the top surface of said inclined outgoing mail tray compartment provides said mail chute for incoming mail to slide into said mail storage and retrieval area inside the lower portion of said mailbox.

5. The mailbox according to claim 1 wherein said inclined outgoing mail tray compartment provides protection against outgoing mail being ejected by wind.

6. The mailbox according to claim 2 wherein said top door is attached and hinged at the bottom upon the downward angled lower extended front portion of said inclined outgoing mail tray compartment, said lower extended front portion of said inclined outgoing mail tray compartment is contiguous and sufficiently angled downward, and extended outward to provide a weather and security shield for said bottom door and said mail storage and retrieval area.

7. The mailbox according to claim 2 wherein said bottom door is secured at the top with said outdoor mailbox utility lock at the center upper portion of said bottom door, is secured by said lock, latched underneath and behind said cross-member of said front frame, thus protecting said bottom door from prying, theft and weather by said downward angled lower extended front portion of said inclined outgoing mail tray compartment.

8. The mailbox according to claim 2 wherein said horizontal mail storage and retrieval area of said mailbox is of sufficient size and capacity to adequately store several weeks of unretrieved mail.

9. The mailbox according to claim 1 wherein said conveniently contiguous areas for incoming, outgoing mail, mail storage and retrieval are accessed from substantially the same vertical level, are closely combined for the convenience of operation by both the mail carrier and mail customer.

* * * * *